United States Patent [19]

Tamura

[11] Patent Number: 4,723,528

[45] Date of Patent: Feb. 9, 1988

[54] DIAGNOSING SYSTEM FOR AN EXHAUST GAS RECIRCULATION SYSTEM OF AN AUTOMOTIVE ENGINE

[75] Inventor: Ikuo Tamura, Mitaka, Japan

[73] Assignee: Fuji Jukogyo Kabushiki Kaisha, Tokyo, Japan

[21] Appl. No.: 20,915

[22] Filed: Mar. 2, 1987

[30] Foreign Application Priority Data

Feb. 28, 1986 [JP] Japan ..... 61-043599

[51] Int. Cl.[4] ..... F02M 25/06

[52] U.S. Cl. ..... 123/571; 123/568

[58] Field of Search ..... 123/479, 568, 569, 571

[56] References Cited

U.S. PATENT DOCUMENTS

| | | | |
|---|---|---|---|
| 4,004,559 | 1/1977 | Itoh | 123/568 |
| 4,075,992 | 2/1978 | Linder et al. | 123/571 X |
| 4,375,800 | 3/1983 | Otsuka et al. | 123/571 |
| 4,428,355 | 1/1984 | Yokooku | 123/571 |
| 4,432,331 | 2/1984 | Yasuhara | 123/571 |
| 4,583,176 | 4/1986 | Yamato et al. | 123/479 X |
| 4,665,882 | 5/1987 | Otobe | 123/571 |

FOREIGN PATENT DOCUMENTS

| | | | |
|---|---|---|---|
| 2815109 | 11/1978 | Fed. Rep. of Germany | 123/571 |
| 0123345 | 9/1980 | Japan . | |

*Primary Examiner*—Willis R. Wolfe

*Attorney, Agent, or Firm*—Martin A. Farber

[57] ABSTRACT

An exhaust gas recirculation system has an EGR passage communicating an exhaust pipe of an engine with an intake passage of the engine and an EGR valve provided in the EGR passage. Flow rate of recirculated gas in the EGR passage is detected and an actual EGR rate signal is produced dependent on the flow rate. A desired EGR rate signal including an allowable range is obtained in accordance with opening degree of the EGR valve. A trouble signal is generated as an alarm signal when the actual EGR rate signal is out of the allowable range.

2 Claims, 3 Drawing Figures

DIAGNOSING SYSTEM FOR AN EXHAUST GAS RECIRCULATION SYSTEM OF AN AUTOMOTIVE ENGINE

BACKGROUND OF THE INVENTION

The present invention relates to a system for diagnosing troubles of an exhaust gas recirculation system for an automotive engine.

If a trouble or malfunction occurs in the exhaust gas recirculation (hereinafter called EGR) system, amount of NOx in exhaust gases increases. Accordingly, a diagnosing system is provided for the EGR system so as to alarm the trouble or malfunction of the EGR system.

Japanese Patent Laid Open 55-123345 discloses a diagnosing system for the EGR system which produces an alarm signal when opening degree of an EGR valve deviates from a desired value over a predetermined allowable range. In the EGR system, the carbon in the recirculated gas is liable to stick to an inner wall of an exhaust gas recirculation passage and a port of the EGR valve to reduce inner diameters of the passage and port, which reduces the rate of the EGR. It should be noted that the EGR system must operate to keep a proper EGR rate. The above mentioned prior art can not diagnose such a trouble, if the EGR valve operates normally.

SUMMARY OF THE INVENTION

The object of the present invention is to provide a diagnosing system which detects the actual EGR rate and diagnoses whether the actual EGR rate deviates from a desired EGR rate, whereby a proper EGR rate may be kept.

According to the present invention, there is provided a diagnosing system for an exhaust gas recirculation system having an EGR passage communicating an exhaust pipe of an engine with an intake passage of the engine, an EGR valve provided in the EGR passage, control means for opening the EGR valve in accordance with engine operating conditions. The diagnosing system comprises first means for detecting flow rate of recirculated gas in the EGR passage and for producing an actual EGR rate signal dependent on the flow rate, second means for producing a desired EGR rate signal including an allowable range in accordance with engine operating conditions, and third means responsive to the actual EGR rate signal and the desired EGR rate signal for producing a trouble signal as an alarm signal when the actual EGR rate signal is out of the allowable range.

In an aspect of the invention, the second means includes a potentiometer provided for detecting opening degree of the EGR valve, and the desired EGR rate signal is obtained based on the opening degree.

The other objects and features of this invention will be apparently understood from the following description with reference to the accompanying drawings.

DETAILED DESCRIPTION OF THE PREFERRED EMBODIMENT

Figure 1:
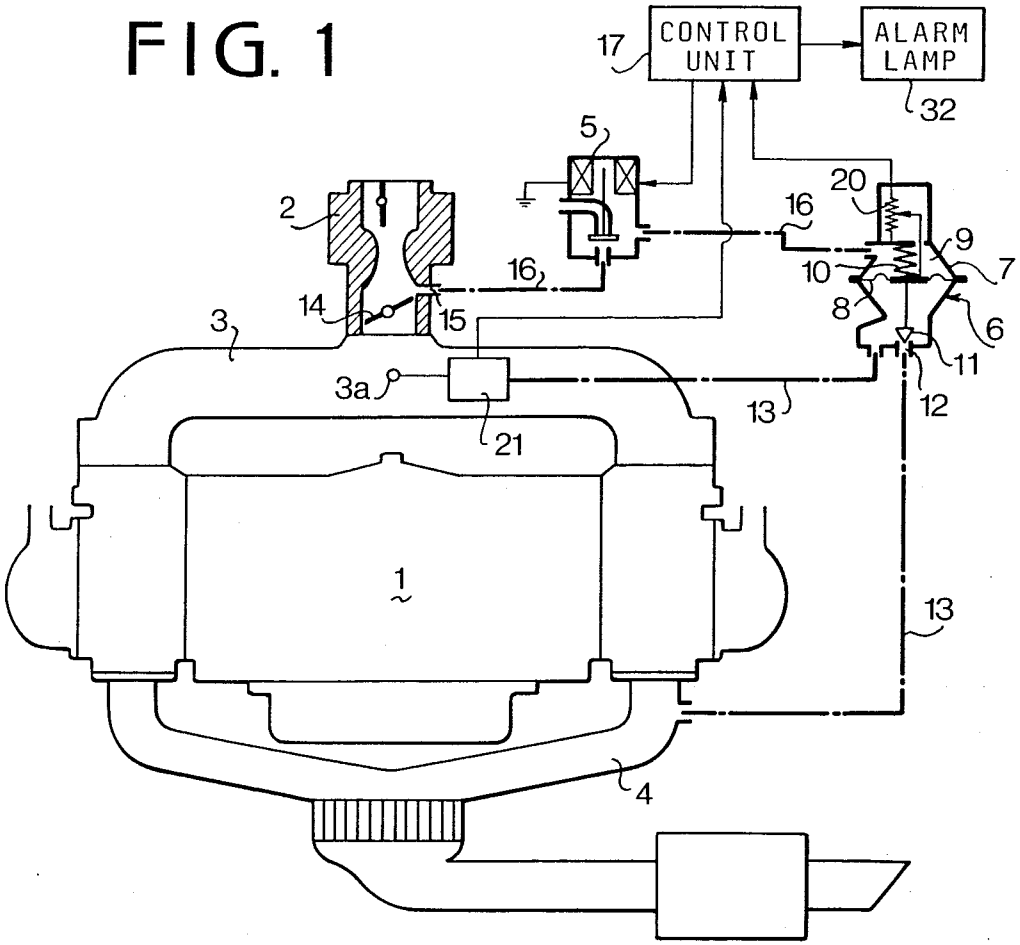
FIG. 1 is a schematic diagram of a system according to the present invention.

Referring to FIG. 1, an automotive engine 1 has a carburetor 2 communicated with an intake manifold 3 and an exhaust pipe 4. The exhaust pipe 4 is communicated with the intake manifold 3 at a turning point 3*a*, passing through an EGR passage 13 and an EGR valve 6. The EGR valve 6 has a vacuum chamber 9 defined by a diaphragm 8 in a housing 7, a valve body 11 secured to the diaphragm 8, and a spring 10 for urging the diaphragm 8 to press the valve body 11 against a valve seat 12 defining a valve port. The vacuum chamber 9 is communicated to the intake passage in the carburetor 2 at a signal port 15 provided just above swinging end of a closed throttle valve 14, passing through a passage 16 and a solenoid operated valve 5.

A potentiometer 20 as a sensor for detecting the opening degree of the EGR valve 6 is provided to detect the deflection of the diaphragm 8. Further, a flow meter 21 is provided on the EGR passage 13 for sensing the flow rate of the EGR gas.

Figure 2:
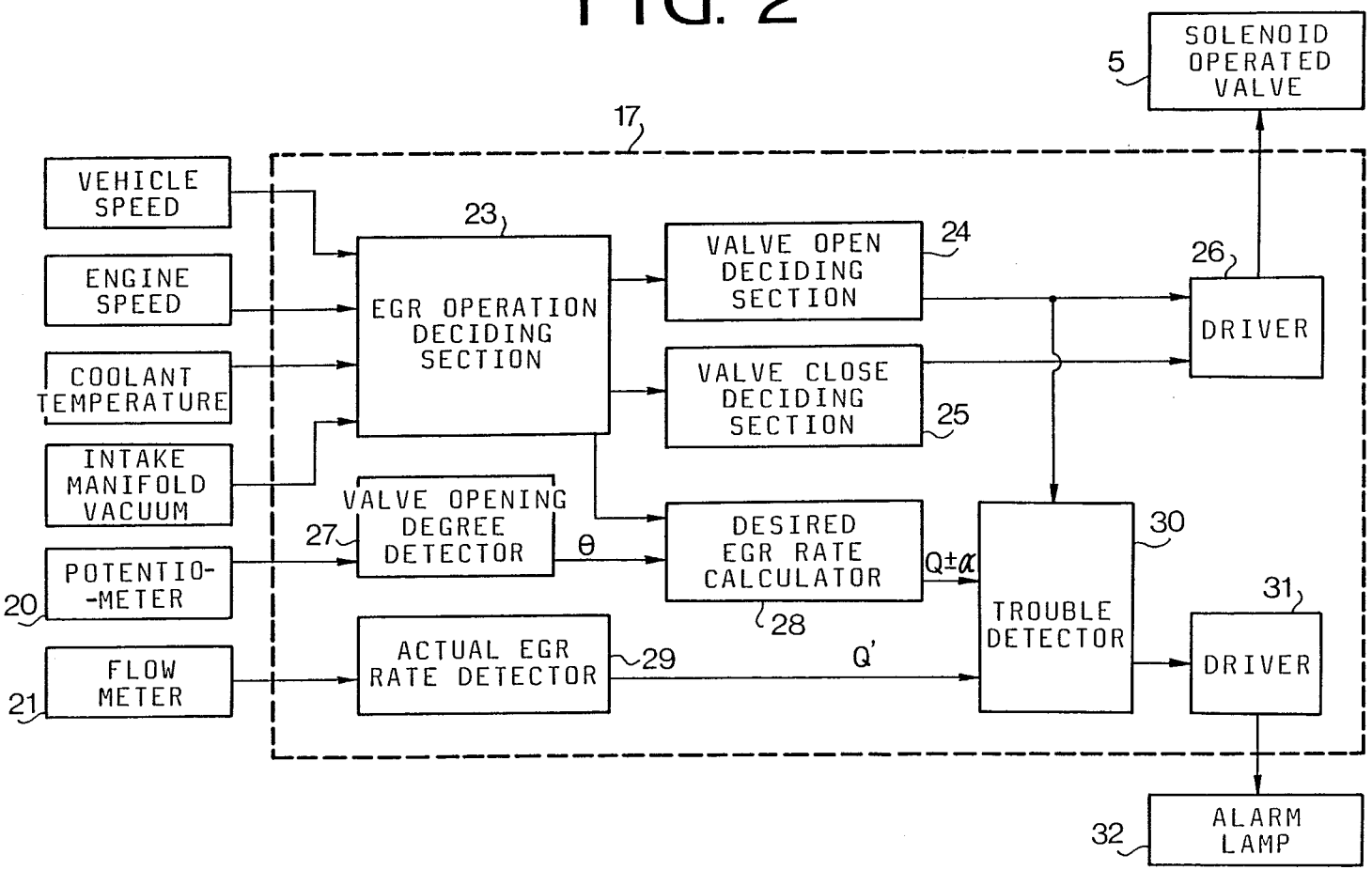
FIG. 2 is a block diagram of a control unit.

Referring to FIG. 2, the output signal of the potentiometer 20 is fed to a valve opening degree detector 27 in a control unit 17, and the output signal of the flow meter 21 is applied to an actual EGR rate detector 29. The control unit 17 has an EGR operation deciding section 23 which is applied with signals of vehicle speed, engine speed, coolant temperature and intake manifold vacuum. The section 23 feeds a valve open signal to a valve open deciding section 24 and a valve close signal to a valve close deciding section 25 in accordance with the driving condition of the vehicle and engine operating conditions. Each of output signals of both sections 24 and 25 is applied to solenoid operated valve 5 through a driver 26.

Figure 3:
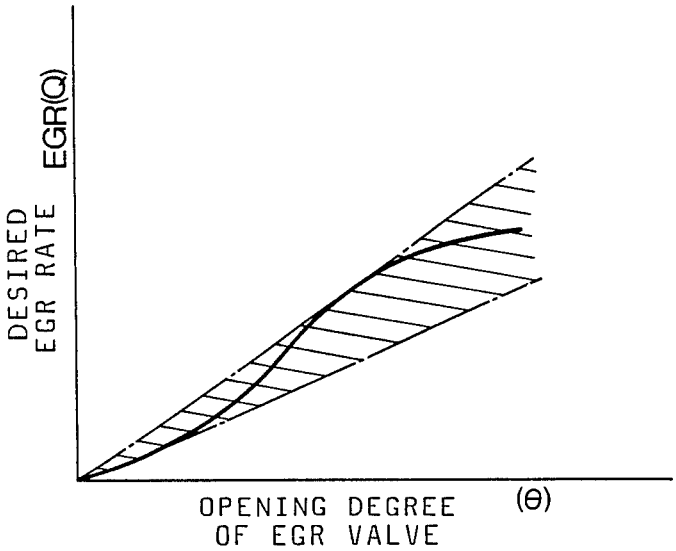
FIG. 3 is a graph showing relationship between opening degree of an EGR valve and a desired EGR rate.

On the other hand, an output signal $\theta$ of the valve opening degree detector 27 is applied to a desired EGR rate calculator 28. The calculator 28 has a look-up table storing a plurality of desired EGR rates with respect to opening degrees of the EGR valve 6. FIG. 3 shows the relationship between the EGR rate Q and the opening degree $\theta$ of the EGR valve. The portion indicated by a plurality of oblique lines is an allowable range $\alpha$. The calculator 28 produces a desired EGR rate $Q \pm \alpha$ dependent on the look-up table in response to the valve open signal from the section 23. The desired EGR rate $Q \pm \alpha$, an actual EGR rate Q' from the detector 29, and the output signal of valve open deciding section 24 are applied to a trouble detector 30. When the actual EGR rate Q' is in the allowable range $Q \pm \alpha$, the EGR system is in a normal state. The trouble detector 30 produces a trouble signal when the actual EGR rate Q' is out of the allowable range $Q \pm \alpha$. The trouble signal is fed to an alarm lamp 32 through a driver 31.

In operation, when the EGR operation deciding section 23 produces the valve open signal in accordance with input signals representing engine operating conditions and vehicle driving conditions, the valve open deciding section 24 produces the output signal, so that the solenoid operated valve 5 is opened. Accordingly, low pressure in the intake manifold 3, which is dependent on the opening degree of the throttle valve 14, is applied to the vacuum chamber 9 to open the EGR valve 6. Thus, a part of the exhaust gas is recirculated to the engine. When the operation of the EGR system deteriorates, the actual EGR rate Q' deviates from the allowable range $Q \pm \alpha$, so that the trouble detector 30 produces the trouble signal. Thus, the lamp 32 is lighted. When the EGR valve malfunctions and signals $Q \pm \alpha$ and $Q'$ are not produced, the trouble detector 30 produces the trouble signal under the condition of existence of the output signal of the valve open deciding section 24.

While the presently referred embodiment of the present invention has been shown and described, it is to be understood that this disclosure is for the purpose of illustration and that various changes and modifications may be made without departing from the spirit and scope of the invention as set forth in the appended claim.

What is claimed is:

1. A diagnosing system for an exhaust gas recirculation system having an EGR passage communicating an exhaust pipe of an engine with an intake passage of the engine, an EGR valve provided in the EGR passage, control means for opening the EGR valve in accordance with engine operating conditions, the diagnosing system comprising:

first means for detecting flow rate of recirculated gas in the EGR passage and for producing an actual EGR rate signal dependent on the flow rate;

second means for producing a desired EGR rate signal including an allowable range in accordance with engine operating conditions; and third means responsive to the actual EGR rate signal and the desired EGR rate signal for producing a trouble signal as an alarm signal when the actual EGR rate signal is out of the allowable range.

2. The diagnosing system according to claim 1 wherein the second means includes a potentiometer provided for detecting opening degree of the EGR valve, and the desired EGR rate signal is obtained based on the opening degree.

* * * * *